United States Patent [19]

Luthra

[11] Patent Number: 4,677,034

[45] Date of Patent: Jun. 30, 1987

[54] COATED SUPERALLOY GAS TURBINE COMPONENTS

[75] Inventor: Krisham L. Luthra, Schenectady, N.Y.

[73] Assignee: General Electric Company, Schenectady, N.Y.

[21] Appl. No.: 479,618

[22] Filed: Mar. 28, 1983

Related U.S. Application Data

[63] Continuation-in-part of Ser. No. 387,725, Jun. 11, 1982, abandoned.

[51] Int. Cl.[4] ..... B32B 15/04

[52] U.S. Cl. ..... 428/678; 428/679; 428/680; 428/685

[58] Field of Search ..... 428/656, 678–680, 428/685, 666, 667, 937

[56] References Cited

U.S. PATENT DOCUMENTS

| | | | |
|---|---|---|---|
| 3,652,235 | 3/1972 | Manilla et al. | 428/667 |
| 3,664,765 | 5/1972 | Ishimatsu et al. | 428/667 |
| 3,676,085 | 7/1972 | Evans et al. | 428/678 |
| 3,873,347 | 3/1975 | Walker et al. | 117/71 M |
| 3,957,454 | 5/1976 | Bessen | 428/937 |
| 3,993,454 | 11/1976 | Giggins, Jr. et al. | 29/194 |
| 3,998,603 | 12/1976 | Rairden | 29/197 |
| 4,024,294 | 5/1977 | Rairden, III | 427/42 |
| 4,101,713 | 7/1978 | Hirsch et al. | 428/554 |
| 4,101,715 | 7/1978 | Rairden | 428/652 |

OTHER PUBLICATIONS

"Operational Performance and Maintenance Improvement", Section 6 of Final Report No. 74GTD57 (under Contract 0-35510 with the U.S. Maritime Administration), Nov. 1, 1974, pp. 6-1, 6-7, 6-8, 6-21, 6-27, 6-29, 6-31, and 6-32.

Report Under Contract N00173-77-C-0253-"A Study of the Mechanism of Hot Corrosion in Environments Containing NaCl: Task 1: Pitting, Task 2: Galvanic Coupling", [Nov. 1979, pp. 16, 17 & FIG. 11].

"Low Temperature Hot Corrosion of Cobalt-Base Alloys", (Parts I & II), [*Metallurgical Transactions A*, vol. 13A, Oct. 1982, pp. 1843-1864].

S. B. Shepard-"Navsea Marine Gas Turbine Materials Development Program", [*Naval Engineers Journal*, Aug. 1981, pp. 65-75].

"Low- and High- Temperature (1300 and 1650 F) Burner Rig Tests of MCrAlY Composition Variations" by Louis F. Aprigliano [David W. Taylor Naval Ship Research and Development Center-Report DTNSRDC/SME-79/35, Aug. 1979, pp. 9, 12 and 13].

"Metallic Coating Development and Evaluation Program" [Report under Contract No. N00024-78-C-5337 for Naval Sea Systems Command, Dept. of Navy, Nov. 1979, pp.4, 5 and 31].

*Primary Examiner*—L. Dewayne Rutledge
*Assistant Examiner*—John J. Zimmerman
*Attorney, Agent, or Firm*—Paul E. Rochford; James C. Davis, Jr.; Paul R. Webb, II

[57] ABSTRACT

Low temperature regime hot corrosion of superalloy components in gas turbines is reduced by the application thereover of cobalt-chromium alloys, the chromium content of such coatings (final composition) being in the 37.5-50 weight percent range. To the extent practicable, aluminum content in these coatings is kept to a minimum. In any event, during the annealing step some small amount at least of aluminum migrates from the superalloy into the coating. At completion of the annealing operation, the alluminum content at the exterior surface of the final coating, however, is to be less than the concentration of aluminum that will form a continuous film of aluminum oxide.

2 Claims, 8 Drawing Figures

COATED SUPERALLOY GAS TURBINE COMPONENTS

BACKGROUND OF THE INVENTION

This application is a continuation-in-part of U.S. patent application Ser. No. 387,725 filed June 11, 1982 now abandoned.

The detrimental effects or liquid sodium sulfate ($Na_2SO_4$) deposits on the lives of gas turbine components have been known for over twenty-five years. Sodium sulfate forms by the combustion of fuels containing sodium and sulfur impurities with air, which may also have sodium content, typically in the form of NaCl. The mechanism of this corrosion reaction, commonly known as hot corrosion, has been extensively studied. Then a few years ago, it was unexpectedly found that gas turbines operating in marine environments exhibited rapid degradation of first stage CoCrAlY coated blades under low power conditions where the metal temperatures (about 650°-750° C.) were considerably lower than the melting point of sodium sulfate (i.e. 884° C.). This type of attack will be referred to herein as "low temperature hot corrosion" and it is to be understood that in view of differences in terminology the term also covers the type of hot corrosion referred to as "intermediate temperature" hot corrosion.

At first, this mode of attack was attributed to the presence of sodium chloride particles ingested into the gas turbine through the air intake. Attempts were made to determine the effect of sodium chloride on the sodium sulfate-induced corrosion. However, the morphology of attack produced in laboratory tests proved to be quite different from that found on actual gas turbine components and it was concluded that sodium chloride is not responsible for introducing the kind of attack observed on CoCrAlY coatings under low power conditions. These same coatings perform satisfactorily at temperatures above the melting point of sodium sulfate. Similar low temperature hot corrosion problems have been observed in land based turbines on components thereof operating at lower temperatures.

BRIEF DESCRIPTION OF THE INVENTION

It is, therefore, an object of this invention to provide a coating (e.g. about 3 mils to about 10 mils thick) for nickel-base, cobalt-base and iron-base superalloy gas turbine components exhibiting good low temperature hot corrosion resistance coupled with at least acceptable high temperature hot corrosion resistance. Most of the superalloys of interest generally contain some aluminum.

This objective is attained with the instant invention by the application of cobalt-chromium alloys over such superalloy gas turbine components, the chromium content of such coatings being in the 37.5-50 weight percent range as measured in the final (after annealed) coating. The aluminum content of these coatings is to be kept to a minimum. However, even though the deposit made on the superalloy substrate component to generate the final coating will, preferably, be substantially free of aluminum, the aluminum content can be expected to increase as aluminum atoms migrate from the superalloy substrate during annealing. The annealing step develops an interdiffusion zone partly from the substrate and partly from the initial coating deposit, which metallurgically bonds the final coating to the substrate. In any event, the coated, annealed superalloy components ready for incorporation in a gas turbine should have an aluminum content at the exterior surface of the final coating, that is less than the concentration of aluminum which will form a continuous film of aluminum oxide.

BRIEF DESCRIPTION OF THE DRAWINGS

The features of this invention believed to be novel and unobvious over the prior art are set forth with particularity in the appended claims. The invention itself, however, as to the organization, method of operation and objects and advantages thereof, may best be understood by reference to the following description taken in conjunction with the accompanying drawings wherein:

MANNER AND PROCESS OF MAKING AND USING THE INVENTION

Figure 1:
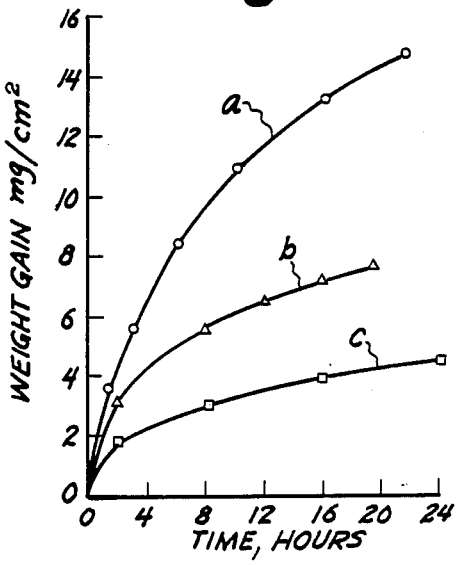
FIGS. 1 and 2 graphically display the weight gain/unit area in laboratory tests of superalloy pins with various alloy coatings.

For gas turbines operating in marine environments, first stage vanes and blades are typically designed to operate between 650° and 950° C. with the operation being predominately in the 900°-950° C. temperature range (i.e. the high power operating regime). Heretofore marine gas turbine components have been designed to cope with the operating parameters encountered in the high power mode of operation. However, because of the constraints imposed by the increased cost of fuel, a change in the operating regime for gas turbines has become necessary so that a greater percentage of the operation of the turbine now occurs under low power. This economy-dictated change in operating mode has sharply focused the existence of the problem defined hereinabove in connection with the utilization of gas turbines in marine service. By way of example, typical present-day operation for gas turbines in marine service will consist of low power operation (about 650°-750° C.) about 90 percent of the time and high power operation (about 900°-950° C.) the rest of the time.

As a consequence, in the case of gas turbines operating in such environments, during low power operation the first stage vanes and blades will be subjected to low temperature hot corrosion. In the case of a multi-stage gas turbine, when the turbine is operated at high power, the first stage vanes and blades will be subjected to the higher temperature hot corrosion, but one or more of the downstream stages of vanes and blades will be subjected to low temperature hot corrosion. It is particularly to those components (e.g. vanes and blades) exposed to low temperature hot corrosion or to both low temperature and higher temperature hot corrosion that this invention is directed.

Thus, in a given gas turbine to be operated under conditions, which can be expected to precipate low temperature hot corrosion, one or more sets of stationary vanes and turbine blades would be constructed according to the instant invention. That is, each vane or blade would comprise a body made of material selected from the group consisting of cobalt-base superalloys, nickel-base superalloys and iron-base superalloys and each such body would have an alloy coating providing the outer surface for the body wherein the final coating would have a substantially uniform composition at least on a macroscopic basis composed of, on a weight basis, approximately 37.5–50 percent chromium and the balance cobalt and impurities ordinarily associated with these constituents. It may also be desirable to employ 0–5 weight percent of an additive from the group consisting of elements like yttrium, hafnium, zirconium or cerium and/or 0–15 weight percent silicon. The yttrium, hafnium, zirconium and cerium additions may be in the form of oxides. In general, small concentrations of many rare earth elements and their oxides are added to coatings.

These coatings can be applied to the nickel-base, cobalt-base or iron-base superalloy by such deposition methods as electron-beam techniques or plasma spray techniques, these deposition methods being particularly useful for applying coatings to non-symmetrical bodies, such as gas turbine vanes and blades which, in all designs that are at least reasonably efficient, present curved surfaces (i.e., usually in the shape of an airfoil) to the hot gas. Such techniques for the deposition of alloy coatings are described in the textbook *Vapor Deposition* by Powell, Oxley and Blocher, Jr. [John Wiley & Sons, Inc., pages 242–246, 1966]; the article "Alloy Deposition From Single and Multiple Electron Beam Evaporation Sources" by K. Kennedy [A paper presented to the AVS at 1968 Regional Symposia Throughout the U.S.]; "Vacuum Plasma Spray Process and Coatings"—Wolfe and Longo [Trans. 9th Int. Thermal Spraying Conference, page 187 (1980)]and "Low Pressure Plasma Spray Coatings for Hot Corrosion Resistance"—Smith, Schilling and Fox [Trans. 9th Int. Thermal Spraying Conference, page 334 (1980)].

In describing this invention, compositions may be referred to either as initial compositions or final coating compositions. Unless otherwise stated, coating compositions given herein refer to initial composition, which is the pre-powder formation composition in the case of plasma spraying or the as-deposited composition in the case of electron-beam evaporation. The difference between initial composition and final coating composition is due predominantly to impurity content and to interdiffusion during the annealing step. Thus, as to impurity content encountered with plasma spraying, at present two processes are used for the preparation of the powder. These processes are atomization and attrition. Even though the initial composition used for powder preparation is the same, the compositions of the resulting powders made by these two processes will differ slightly from each other and from the initial composition.

When any of these coatings are later annealed, the interdiffusion which occurs contributes still a further change in composition reflected in the finely-coating composition.

Examination of the cobalt-chromium phase diagram shows that the cobalt-chromium content of coatings of this invention consist of two finely-dispersed phases. However, viewed on a macroscopic scale, the cobalt-chromium composition is typically uniform (i.e. ±4%) throughout the coating either before or after annealing (i.e. in the final coating) and, therefore, the concentration of cobalt and the concentration of chromium each can be considered as being substantially uniform. This characterization of the cobalt-chromium content of the coating is readily verifiable by the use of electron microprobe traces, X-ray diffraction analysis and/or microscopic examination. It is not, however, critical to this invention that the cobalt-chromium content be present in substantially uniform concentration across the thickness of the coating, since some gradient can be present without detracting from the effectiveness of the protection afforded.

Laboratory tests have been conducted with specimens of cobalt-base and nickel-base superalloys provided with alloy coatings including the coatings of this invention. Also reported herein are burner rig tests conducted with specimens of nickel-base superalloys provided with alloy coatings including coatings encompassed within this invention. Burner rig tests on similarly coated specimens of cobalt- or iron-base superalloys would be expected to yield similar results. It has been definitely established that under low temperature (i.e. about 650°–750° C.) hot corrosion conditions, the low aluminum content Co-Cr alloy coatings of this invention perform very well. This is particularly interesting, because it has normally been believed that the presence of chromium and sufficient aluminum at the surface to form a continuous film of aluminum oxide is necessary to provide good hot corrosion resistance and there is no question that aluminum content in a concentration to provide a continuous protective $A1_2O_3$ film (i.e. at least about 3 percent by weight) improves the corrosion resistance of Co-Cr alloy coatings under higher temperature (i.e. about 900° C.) hot corrosion conditions.

Figure 2:
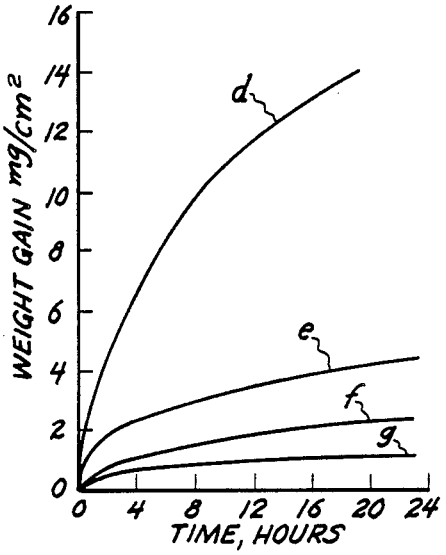
Figure 8:
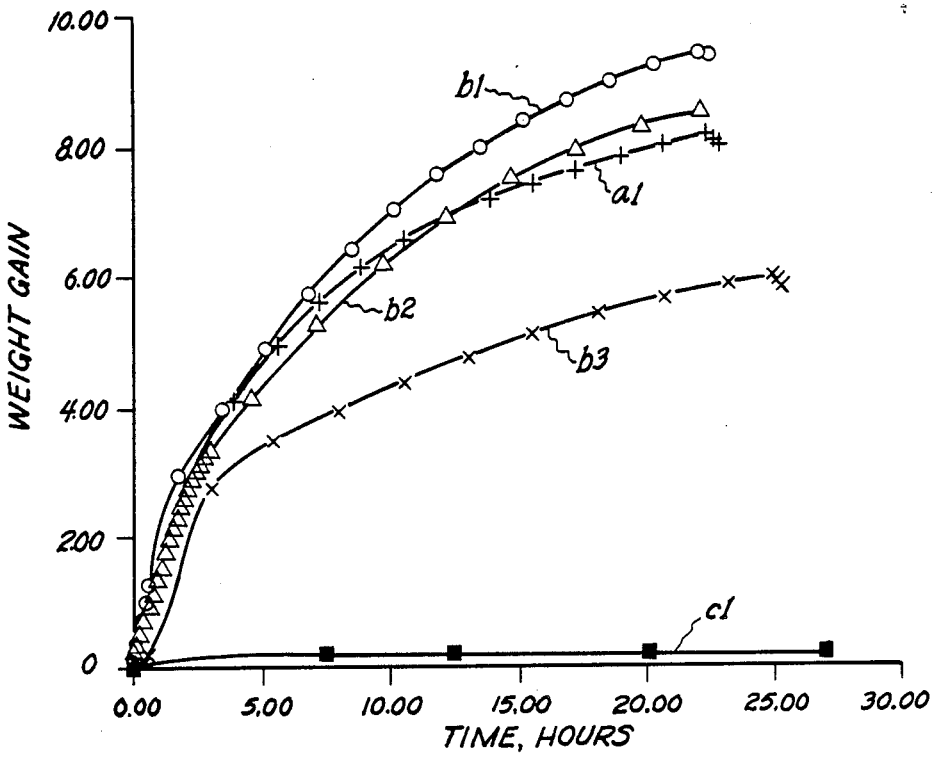
FIG. 8 is a graph displaying corrosion behavior of various chromium content coatings thereby defining the low end of the protection regime.
Figure 1:
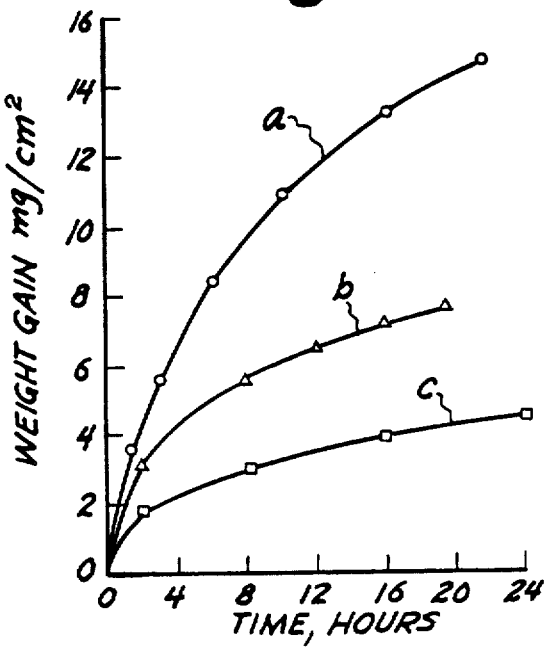
Figure 2:
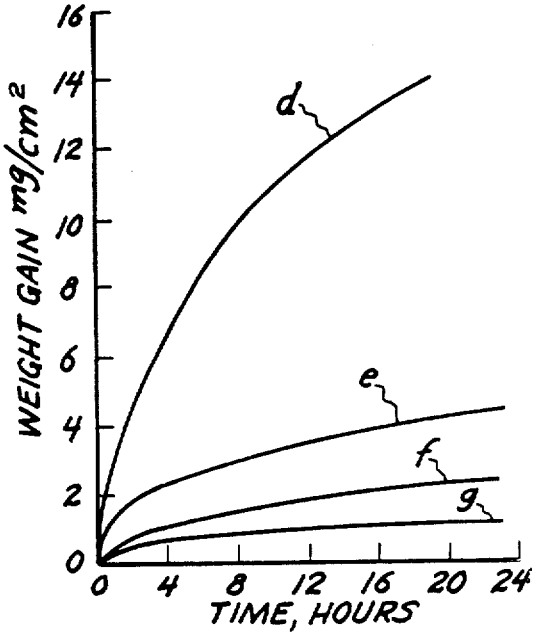
Figure 3:
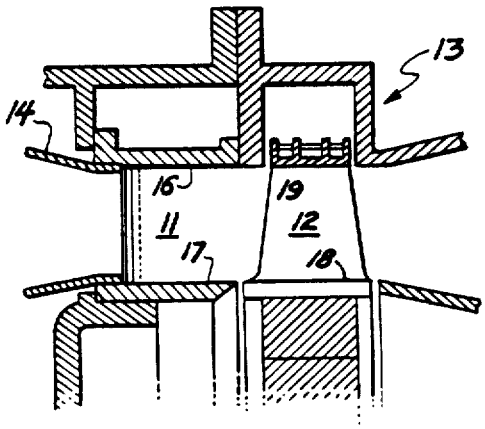
Figure 4:
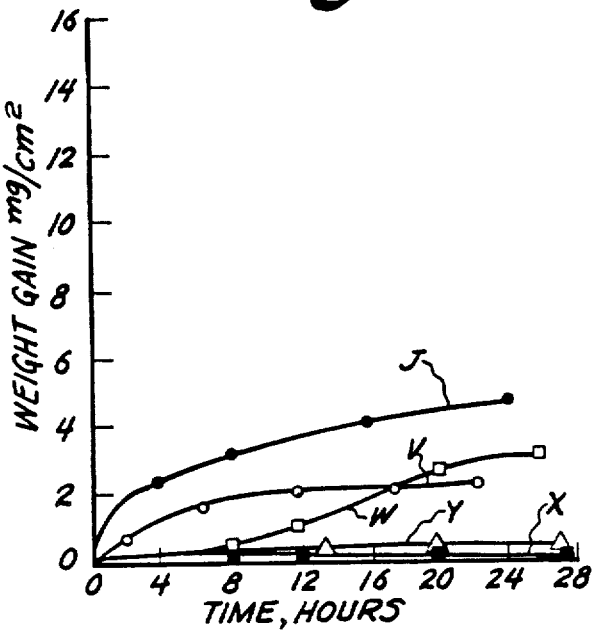

The results of laboratory tests at 750° C. and at 900° C. are displayed in graphic form in FIGS. 1 and 2. Additional laboratory tests are described in connection with FIG. 8. Each specimen in FIGS. 1 and 2 was a standard size superalloy pin having an alloy coating about 5 mils thick vapor deposited thereon by electron beam evaporation. All coating compositions are expressed in weight percent and represent the as-deposited composition. Each specimen received a coating of $Na_2SO_4$ (concentration 2.5 mg/cm$^2$). The tests consisted of exposing the $Na_2SO_4$ specimens at the testing temperature to a gaseous environment [oxygen containing 0.15 vol. % ($SO_2+SO_3$)]and then determining the weight gain. The $Na_2S0_4$ coating was applied by spraying water saturated with the salt on the surface of the specimens at 100°–150° C. The water evaporated and left a coating of the salt on the specimen. The process was continued until the desired salt concentration had been deposited. Correlation of the curves, specimen make-up and testing temperature is as follows:

TABLE I

| CURVE | SPECIMEN | TEMPERATURE (°C.) |
|---|---|---|
| a | Rene 80 coated with Co—22Cr—12Al—0.1Y | 750 |
| b | X-40* coated with Co—40Cr | 750 |
| c | Rene 80 coated with Co—40Cr | 750 |
| d | Rene 80 coated with Co—22Cr—12Al—0.1Y | 750 |
| e | Rene 80 coated with Co—40Cr | 750 |
| f | Rene 80 coated with Co—22Cr—12Al—0.1Y | 900 |
| g | Rene 80 coated with Co—40Cr | 900 |

*Composition: Co—25Cr—10Ni—7.5W—1Fe—0.5C

The results of burner rig tests are set forth in Table II (1350° F., 732° C.) and Table III (1600° F., 871° C.). Pin specimens (3/16" dia×1" long) received an alloy coating by plasma spray deposition about 5–7 mils thick. These specimens were annealed for 2 hours; the annealing temperatures were 1120° C. (for the specimens having IN-738 substrates and 1218° C. for the specimens having René 80 substrates). The fuel employed in the burner rig tests was liquid clean distillate (JP5) containing 1 wt % sulfur and 125 ppm of sodium as NaCl. The fuel was burned with air at an air/fuel ratio of 57. Total air flow was 35.5 lbs/hr. In the 1350° F. tests, $SO_2$ was added to the combustion gases at the rate of 784 cc/minute. The corrosion time data with corresponding corrosion penetration indicates that after the given test time the designated corrosion penetration into the coating had occurred. Coating compositions represent initial (i.e. pre-powder formation) compositions given in weight percent.

TABLE II

| Substrate Alloy | Initial Coating Deposit | Corrosion Time (in Hours) | Corrosion Penetration (in Mils) |
|---|---|---|---|
| IN-738* | Co—29Cr—6Al—1Y | 531 | 10.8** |
| | | 531 | 11.9** |
| | Co—35Cr—6Al—1Y | 216 | 7.2** |
| | | 216 | 5.6 |
| | Co—29Cr—6Al—0.1Y | 71 | 4.9 |
| | Co—40Cr—0.8Si | 1007 | 2.2 |
| | | 1179 | 3.65 |
| | Co—43Cr | 1007 | 0.5 |
| | Co—48Cr—0.6Si | 1021 | 0.5 |
| | | 2070 | 0.55 |
| Rene 80* | Co—29Cr—6Al—1Y | 118 | 9.35** |
| | | 172 | 10.5** |
| | Co—40Cr | 1046 | 0.3 |
| | Co—40Cr—0.8Si | 1007 | 0.25 |
| | | 1179 | 0.8 |
| | | 2070 | 0.4 |
| | Co—43Cr | 1007 | 1.05 |
| | Co—48Cr—0.6Si | 2070 | 0.6 |
| | Co—48Cr—0.1Y | 1000 | 3.2 |

*IN-738 composition - Ni—8.5Co—16.0Cr—3.4Al—3.4Ti—1.75Mo—2.6W—0.9Cb—1.75Ta—0.010B—0.4Zr
Rene 80 composition - Ni—9.5Co—14.0Cr—3.0Al—5.0Ti—4.0W—4.0Mo—0.15B—0.03Zr—0.17C
**Complete coating penetration Metallographic examination of the corroded samples reported in Table III (to follow) shows that at 1600° F. the morphology of attack on the coatings of this invention is somewhat different from the morphology of attack in the case of the CoCrAlY coatings. After testing, the coatings of this invention show a larger degree of internal sulfide and oxide formation and a lesser depth of broad frontal attack than the CoCrAlY coatings tested. Table III sets forth the depth of maximum penetration observed including the internal sulfide and oxide formation, which occurs below the frontal attack. Coating compositions are expressed in weight percent.

TABLE III

| Substrate Alloy | Initial Coating Deposit | Corrosion Time (in Hours) | Corrosion Penetration (in Mils) |
|---|---|---|---|
| In-738 | Co—29Cr—6Al—0.1Y | 1048 | 5.15 |
| | Co—29Cr—6Al—1Y | 1000 | 3–5.5 |
| | Co—43Cr | 1048 | 4.75 |
| | Co—43Cr—0.1Y | 1048 | 5.0 |
| | Co—48Cr—0.1Y | 1048 | 7.0 |
| | Co—48Cr—1Hf | 1048 | 6.0 |
| | Co—48Cr—0.6Si | 1014 | 4.5 |
| Rene 80 | Co—29Cr—6Al—1Y | 1006 | 5.8 |
| | Co—43Cr | 1048 | 5.5 |
| | | 2018 | 7.0 |
| | Co—43Cr—0.1Y | 1048 | 5.35 |
| | Co—48Cr—0.1Y | 1048 | 5.50 |
| | Co—40Cr—0.8Si | 1002 | 4.0 |
| | Co—48Cr—0.6Si | 1002 | 4.6 |

Figure 3:
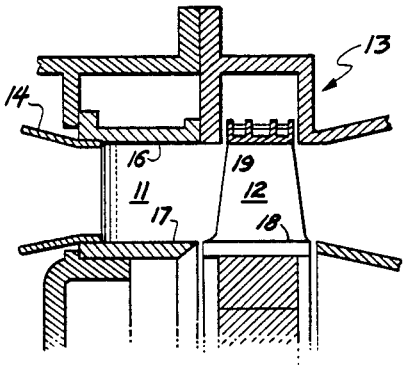
FIG. 3 is a transverse sectional view through the first stage of a gas turbine showing the stationary vanes which direct the hot gas against the rotor-mounted turbine blades.

In the typical application of this invention, that is, a gas turbine operating in a marine environment, the first stage set of vanes 11 and blades 12 of the turbine 13 shown in FIG. 3 would employ coatings according to this invention. Thus, when the unit is operated under low power conditions, the hot gases leaving the combustor (not shown) and entering the first stage through transition piece 14 would expose vanes 11 and blades 12 to temperatures in the 650°–750° C. range. As is shown by the data set forth hereinabove, under the conditions of marine environment operation and the temperature range experienced under low power conditions, the very low Al content (after annealing) Co-Cr alloy coatings of this invention will exhibit outstanding corrosion resistance.

Further, when gas turbine 13 is operated under high power conditions (i.e. about 900°–950° C.), the coatings of this invention are expected to provide corrosion resistance approximating that provided by the CoCrAlY coatings described in U.S. Pat. No. 4,101,715—Rairden. In contrast to the latter coatings containing 3–9 wt. % aluminum, however, the coatings of this invention have particular utility where both regimes of hot corrosion are encountered.

In the event that the gas turbine has multiple sets of stages (not shown in FIG. 3), consideration should be given to providing one or more of such downstream sets of vanes and blades with the protection afforded by the coatings of this invention.

Components flanking the hot gas path, such as casing member 16, platform members 17, 18 and shroud 19 may be constructed of cobalt-base or nickel-base superalloy and protected with the coating of this invention.

Figure 4:
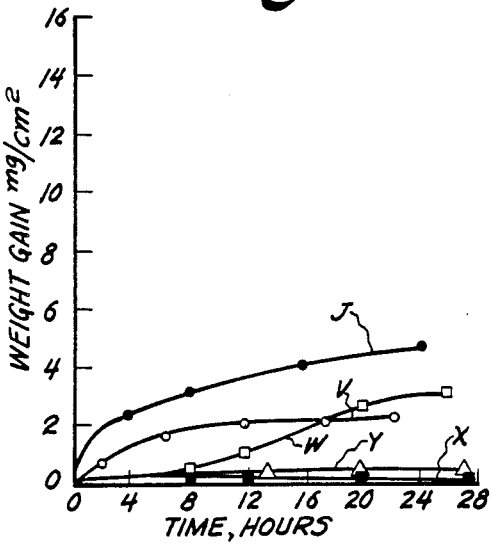
FIG. 4 is a graph displaying corrosion behavior for Co-40Cr alloy coatings deposited on substrates in two different deposition processes and also provides corrosion data for a casting of the same composition.

It has previously been shown in the report "A Study of the Mechanism of Hot Corrosion in Environments Containing NaCl" by Shores and Luthra [Prepared under Contract N00173-77-C-0253 for the Naval Research Laboratory, November 1979, pages 16, 17 and FIG. 11] that the hot corrosion behavior of Co-Cr alloy castings depends on the chromium content of the alloy. FIG. 11 therein shows that weight gain/unit area as a function of time, when exposed to 2.5 mg/cm$^2$ of $Na_2SO_4$ in oxygen containing 0.15% ($SO_2+SO_3$) at 750° C., decreases with increasing chromium content. However, because of the difference in microstructure between coatings and castings and because of the problem of transfer of materials from the substrate to the coating which is not encountered in castings, data obtained from castings cannot be relied upon to predict the behavior of coatings of the same alloy deposited upon a given substrate. The unpredictability of such carryover is graphically displayed in FIG. 4. Corrosion behavior data for coating deposits sprayed and then annealed in different manners on pins of René 80 are shown in curve u (Co-40Cr coating about 5 mils thick applied by electron beam deposition) and in curves v, w and x (Co-40Cr coating about 5 mils thick applied by plasma spray deposition). Curve y provides corrosion behavior data for a casting (i.e. a coupon 40 mils thick) of Co-40Cr alloy. Comparison of the curves shows that whereas one coating (curve x) exhibited better, or comparable, corrosion resistance than the casting (curve y), three coatings (curves u, v, w) exhibited poorer corrosion resistance.

Figure 5:
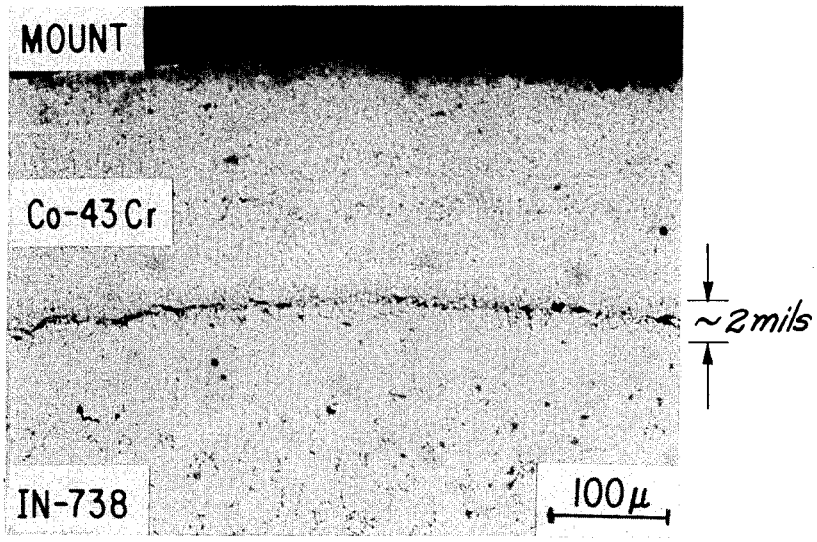
FIG. 5 is a photomicrograph at 200 X magnification showing a superalloy substrate to which has been supplied a coating composition of this invention and the thin transition zone developed between the substrate and the coating.

FIG. 5 is a photomicrograph of the cross-section taken through a layer of Co-43Cr (initial composition) deposited by plasma spray on a substrate of IN-738 and metallurgically bonded thereto by annealing for 2 hours at 1120° C. This specimen was subjected to low temperature (i.e. 1350° F.) hot corrosion for 1007 hours As is shown therein, a thin (about 2 mils) transition zone developed between the Co-43Cr coating and the substrate during anneal. This zone is made up of metal atoms diffused both from the coating into the substrate and from the substrate into the coating.

Annealing of alloy-coated gas turbine components is standard practice in order to develop adequate coating-to-substrate metallurgical bond. It is for this reason that the burner rig tests described above were conducted with specimens, which had been annealed as described. During the annealing process a small amount of aluminum migrated from the underlying superalloy into the coating and even to the surface of the coating in each case. However, as the results (Table II) show, these coatings still exhibited significally improved resistance to low temperature hot corrosion.

The superalloys of interest generally contain some aluminum. Although it would be preferred to keep the protective coating of this invention substantially free of aluminum content (and this will preferably be the condition of the coating deposit prior to annealing), the annealing process promotes the migration of metal atoms from the coating deposit inwardly and from the substrate outwardly. By this mechanism the interdiffusion zone develops and, as well, metal atoms from the substrate are added to the composition of the initial coating deposit. In accordance with this invention the aluminum content of the final annealed coating (i.e. the region outward of the interdiffusion zone), at its outer surface should be less than will enable a continuous film of $Al_2O_3$ to form under turbine operating conditions. This value of aluminum concentration may be in the range of from about 3 to about 5 wt. % aluminum.

In the preferred practice of this invention, the concentration of aluminum at the outer surface of the annealed coating will be less than 0.5 wt. % . The maximum concentration of aluminum at the surface of annealed pins comparable to those prepared, tested and reported in Tables II and III hereinabove was about 0.2 wt. %.

When such annealed components are subjected to operation in a gas turbine, there will be a long term slow diffusion of additional aluminum atoms from the superalloy substrate into the coating. Any significant decrease in resistance to hot corrosion of the coating caused by such increase in aluminum content therein will occur slowly (e.g. upwards of 25,000 hours of turbine operation). It is expected that even with an aluminum concentration approaching 3 wt. % at the surface of the as-annealed coating, such an aluminum content will not be the life-limiting factor for coated superalloys according to this invention used in many applications in which low temperature hot corrosion is encountered.

At this point in time the best mode contemplated is the use of annealed (final) Co-Cr coating compositions containing chromium in the range of about 43 to about 48 percent by weight on nickel-base superalloys and a maximum aluminum content at the surface of the coating of about 0.2 wt. %.

Figure 6:
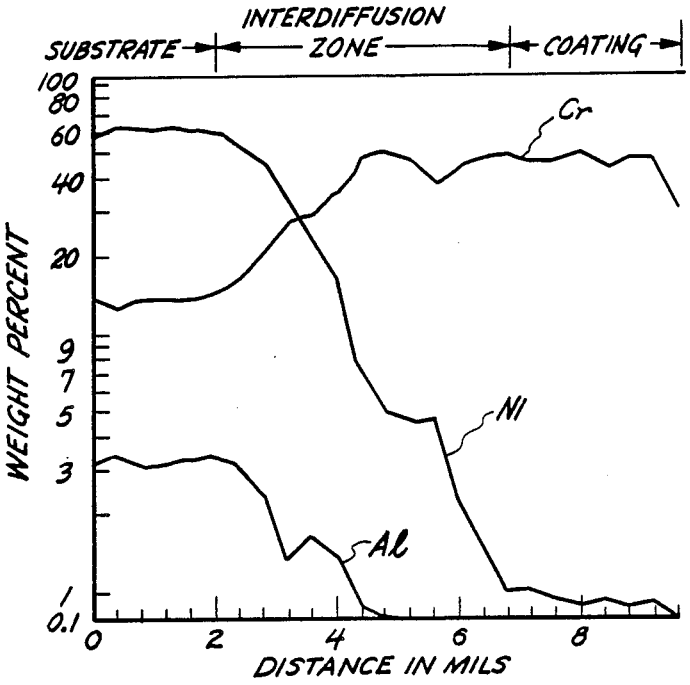
FIG. 6 is an electron microprobe analysis displaying the chromium, nickel and aluminum contents of the final coating, the interdiffusion zone and the adjoining substrate after the annealing for 2 hours at 1218° C. of a composite of Co-48Cr-0.6 Si deposited on a René 80 substrate.
Figure 7:
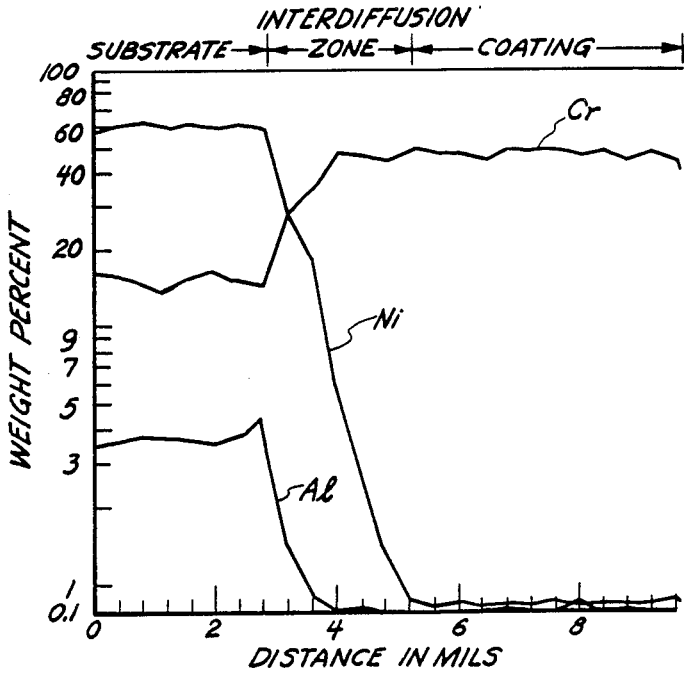
FIG. 7 is an electron microprobe analysis displaying similar information for the after-annealed composite of Co-48Cr-0.6 Si deposited on IN-738 (anneal conducted for 2 hours at 1120° C.)

FIGS. 6 and 7 present data of chromium, nickel and aluminum content of specimen pins of nickel-base superalloys initially coated with Co-48Cr-0.6 Si by plasma spray and then annealed to provide the coating of this invention metallurgically bonded to the substrate via an interdiffusion zone. As would be expected, the data in FIGS. 6 and 7 do not display the concentrations of other metallic components (e.g. Mo, W, Ti, Ta, Cb, etc.), which could be expected to migrate from the superalloy substrate to the interdiffusion zone and possibly to the coating. These metals to the extent they may be present in the coating do not have any significant effect on the coating behavior.

The protection afforded by the coatings of this invention is not manifest as gradual improvement in low temperature hot corrosion resistance as the chromium content is increased from values below the useful range defined herein. On the contrary, as has been established by laboratory tests (represented in FIG. 8) the turning point between useful protection and ineffective protection is pronounced and is reflected in whether or not liquid $Na_2SO_4$ forms during low temperature (i.e. about 750° C.) hot corrosion conditions. In these tests the initial composition of the coating material was as follows:

curve a1 : Co35Cr
curves b1, b2 and b3 : Co37.5Cr
curve c1 : Co40Cr

In each case the coating was applied to a pin of René 80 by plasma spray (powder prepared by attrition). Corrosion tests were conducted at 750° C. The curve c1 is the same as curve x in FIG. 4 and is supplied to provide a basis of comparison.

In each instance in which the initial coating composition had a chromium content equal to or less than 37.5 Cr, liquid $Na_2SO_4$ formed regardless of the perfection or imperfection of surface finish of the coating and rapid corrosion resulted. At initial coating compositions in which the chromium content is equal to or greater than 40 Cr liquid $Na_2SO_4$ generally will not form when the final coating is provided with a proper continuous smooth surface. If minor amounts of liquid $Na_2SO_4$ do form in case of minor surface defects, such corrosion as may occur does so at a much reduced rate. Such was the case with the coatings illustrated in FIG. 4 (curves w and v). It has been determined, therefore, that a definite, previously unknown, significant increase in low temperature hot corrosion resistance is obtained at some chromium content between 37.5 Cr and 40 Cr (initial concentration).

Final coating composition was determined in the case of the specimen of curve cl (initial composition 40 Cr) and was found to have a chromium content of about 37.5 weight percent.

In setting up an industrial process for the preparation of gas turbine components to be afforded the protection of this invention, some prescribed sequence of process steps can be arrived at in a routine manner using the teachings set forth herein to provide a predetermined relationship between initial, or ingot, composition and final (i.e. post anneal) coating composition, the latter being in the range of from about 37.5 to about 50 weight percent.

In the following claims the term "balance essentially cobalt" is used to include, in addition to cobalt, impurities ordinarily encountered with such constituents of the alloy coating as are intentionally employed according to the teachings herein.

What I claim as new and desired to secure by Letters Patent of the United States is:

1. A gas turbine component consisting of a non-symmetrical body made of material selected from the group consisting of nickel-base superalloy, cobalt-base superalloy and iron-base superalloy and an alloy coating metallurgically bonded to said body by means of an interdiffusion zone and providing the outer surface for the coated body, the composition of said coating consisting essentially of (in weight percent) about 43% chromium; about 0.1% yttrium, and oxides thereof; up to 15% silicon; less than the percentage of aluminum which would be required to form a continuous film of aluminum oxide over said outer surface, and the balance essentially cobalt, the concentration of chromium being substantially uniform on a macroscopic scale across the thickness of said coating.

2. A gas turbine component consisting of a non-symmetrical body made of material selected from the group consisting of nickel-base superalloy, cobalt-base superalloy and iron-base superalloy and an alloy coating metallurgically bonded to said body by means of an interdiffusion zone and providing the outer surface for the coated body; said coating having as its major components cobalt and chromium and containing a small amount of yttrium and aluminum, the chromium content being about 43 weight percent measured on a macroscopic scale, the concentration of ytrrium being about 0.1 weight percent, the concentration of aluminum at said outer surface being less than the weight percentage of aluminum which would be required to form a continuous film of aluminum oxide over said outer surface, and the thickness of said coating being in the range of from about 3 mils to about 10 mils.

* * * * *

UNITED STATES PATENT AND TRADEMARK OFFICE

CERTIFICATE OF CORRECTION

PATENT NO. : 4,677,034

DATED : June 30, 1987

INVENTOR(S) : Krisham L. Luthra

It is certified that error appears in the above-identified patent and that said Letters Patent is hereby corrected as shown below:

The sheet of drawings consisting of Figs. 1 and 2 should be deleted to appear as per attached sheet.

Signed and Sealed this

Tenth Day of November, 1987

*Attest:*

DONALD J. QUIGG

*Attesting Officer*

*Commissioner of Patents and Trademarks*